US005300194A

United States Patent [19]

Welkener et al.

[11] Patent Number: 5,300,194

[45] Date of Patent: Apr. 5, 1994

[54] PITCH CONTROL

[75] Inventors: Ulrich Welkener, Antwerpen, Belgium; Thord Hassler, Rydeback, Sweden

[73] Assignee: W. R. Grace & Co.-Conn., New York, N.Y.

[21] Appl. No.: 810,746

[22] Filed: Dec. 19, 1991

[30] Foreign Application Priority Data

Dec. 24, 1990 [GB] United Kingdom ..... 9028010

[51] Int. Cl.[5] ..... D21F 1/32

[52] U.S. Cl. ..... 162/199; 162/168.2; 162/166; 162/164.5; 162/168.5; 162/DIG. 4

[58] Field of Search ..... 162/199, 168.2, 166, 162/164.5, 168.5, DIG. 4

[56] References Cited

U.S. PATENT DOCUMENTS

| | | | |
|---|---|---|---|
| 3,619,351 | 11/1971 | Kolosh | 162/DIG. 4 |
| 3,992,249 | 11/1976 | Farley | 162/199 |
| 4,184,912 | 1/1980 | Payton | 162/DIG. 4 |
| 4,753,710 | 6/1988 | Langley et al. | 162/183 |
| 4,765,867 | 8/1988 | Dreisbach et al. | 162/199 |
| 4,861,429 | 8/1989 | Barnett et al. | 162/199 |
| 4,895,622 | 1/1990 | Barnett et al. | 162/199 |
| 4,913,775 | 4/1990 | Langley | 162/183 |
| 4,925,530 | 5/1990 | Sinclair et al. | 162/181.8 |
| 4,964,955 | 10/1990 | Lamar et al. | 162/199 |
| 4,995,944 | 2/1991 | Aston et al. | 162/199 |
| 5,074,961 | 12/1991 | Dreisbach et al. | 162/199 |

OTHER PUBLICATIONS

Hassler, Thord "Pitch Deposition in Papermaking and the Function of Pitch-Control Agents", TAPPI Journal.

*Primary Examiner*—W. Gary Jones
*Assistant Examiner*—Brenda Lamb
*Attorney, Agent, or Firm*—James P. Barr

[57] ABSTRACT

Accumulation of pitch or stickies in pulp or paper making is controlled by applying to the pulp or paper making equipment which is not in continuous contact with water separately a water soluble cationic polymer and a water soluble anionic polymer.

10 Claims, No Drawings

PITCH CONTROL

This invention relates to the control of pitch and stickies in the manufacture of pulp and paper.

It is well known that "pitch" can accumulate in paper making and also in the manufacture of pulp, causing significant problems. "Pitch" is the term used to describe the sticky materials which appear in paper making; these originate from the wood from which the paper is made. However, nowadays when more recycled paper is used, "pitch" is now used as a general term for all material soluble in organic solvents but not soluble in water, for example the ink or adhesive present in recycled paper. The depositing material originating from recycled fibre is also called "stickies". The pitch or stickies can accumulate at various points in the system. It can block the felt and thus hinder drainage of the paper web. It can adhere to the wires or drying cylinders causing it to pick holes in the paper. It may also deposit on press rolls or other rolls and the like which come into direct or indirect contact with the paper sheet.

Many materials have been used in an attempt to eliminate these problems. Such materials include inorganic treatments such as talc and anionic dispersants. However, conventional dispersants can be ineffective in a closed system as there can be a build-up of "pitch". In such systems the pitch particles have to be removed from the water system in a controlled way without being allowed to accumulate on the felt or rolls or, for example, the pipe work used in the paper making machinery. These products have also been found to give a limited effect and there is a need for further improved treatments. It is also known to spray an aqueous formulation of certain cationic polymers to reduce the build-up of deposits. However this treatment is not fully effective.

It has now been found, according to the present invention, that the build-up of pitch on the papermaking machinery can be controlled by applying thereto both a cationic polymer and an anionic polymer.

Accordingly, the present invention provides a method for the control of pitch or stickies in pulp or paper making which comprises applying to the pulp or papermaking equipment separately which is not in continuous contact with water a water-soluble cationic polymer and a water-soluble anionic polymer.

By using the combination of cationic and anionic polymers it has been found that it is possible to obtain a coating on the pick up felt, paper forming wire, press roll or dandy roll, for example, which prevents pitch from adhering to them. In contrast a machine chest, back water tank or a pipe cannot be treated because these are in continuous contact with the process water. Although the polymers can be applied , for example, by means of a hopper or other applicator it is preferred that the polymers are sprayed onto the equipment. In a particularly preferred embodiment, the anionic product is applied subsequent to the application of the cationic product. By producing a coating on the surfaces in this way there is improved paper machine runnability as well as improved sheet quality resulting from improved performance due to reduced build-up of deposit.

A wide variety of different water soluble cationic and anionic polymers can be employed. It will be appreciated that the invention resides in the application of the polymers rather than in their precise nature. These will generally have a molecular weight from 250 to 500,000. For cationic polymers the preferred molecular weight is 1000 to 100,000, especially 20,000 to 50,000. The charge density (determined by e.g., streaming current potential titration) of suitable polymers is 0.1 to 10, especially 2 to 8, meq/g.

The polymers will normally be formulated as a concentrated aqueous solution, the concentration of each polymer being, in general, from 0.1 to 50% by weight and preferably from 1 to 20% by weight. This concentrate will normally be diluted to an applied concentration from 1 to 10,000 ppm, especially from 1 to 5,000 ppm. The dilution should, of course, be made with water which is sufficiently pure that it does not reverse the charge of the diluted system.

Such compositions can also contain the usual wetting agents (i.e. materials capable of reducing the surface tension of water) and other additives conventionally used for pitch control. In particular cationic or nonionic surfactants may be used with the cationic polymers and anionic or nonionic surfactants may be used with anionic polymers.

The precise nature of the surfactants which may be used is not important and a considerable variety of different surfactants can be used in combination with the polymer component, provided that they are water soluble. Suitable nonionic surfactants include condensation products of ethylene oxide with a hydrophobic molecule such as, for example, higher fatty alcohols, higher fatty acids, alkylphenols, polyethylene glycol, esters of long chain fatty acids, polyhydric alcohols and their partial fatty acid esters, and long chain polyglycol partially esterfied or etherified. A combination of these condensation products may also be used.

Preferred cationic surfactants suitable for use in this invention include water soluble surfactants having molecular weights from 200 to 800 and having the general formula:

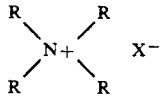

wherein each R is independently hydrogen, a polyethylene oxide group, a polypropylene oxide group, an alkyl group having 1 to 22 carbon atoms, an aryl group, or an aralkyl group, at least one of said R groups being an alkyl group having at least about 8 carbon atoms and preferably an n-alkyl group having 12 to 16 carbon atoms; and wherein $X^-$ is an anion, typically a halide ion (e.g. chloride), or 1/n of an n-valent anion. Mixtures of these compounds can also be used as the surfactant of this invention.

Preferably two of the R groups of the cationic surfactants of the formula are methyl or ethyl, and most preferably methyl; and preferably one R group is an aralkyl group

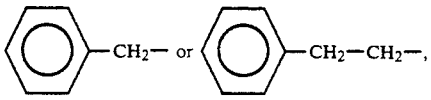

and is most preferably benzyl. Particularly useful surfactants thus include alkyl dimethyl benzyl ammonium chlorides having alkyl groups with 12 to 16 carbon atoms. One commercially available product of this type includes a mixture of alkyl dimethyl benzyl ammonium chlorides wherein about 50% of the surfactant has a $C_{14}H_{29}$ n-alkyl group, about 40% of the surfactant has a $C_{12}H_{25}$ n-alkyl group, and about 10% of the surfactant has a $C_{16}H_{33}$ n-alkyl group. This product is known for its microbicidal effectiveness.

Other surfactants which can be used include the group of pseudo-cationic materials having a molecular weight of 1,000 to 26,000 and having the general formula $NR_1R_2R_3$, wherein $R_1$ and $R_2$ are polyethers such as polyethylene oxide, polypropylene oxide or a combined chain of ethylene oxide and propylene oxide, and wherein $R_3$ is a polyether, alkyl group, or hydrogen. Examples of this type of surfactant are diclosed in U.S. Pat. No. 2,979,528.

The anionic polymers employed will, in general, be sulphonates or carboxylates although it is possible to use polymers derived from natural products such as anionic saccharides, anionic starch and water soluble cellulose derivatives.

Thus suitable anionic polymers include lignin sulphonates, polynaphthalene sulphonates, tannins and sulphonated tannins and melamine formaldehyde condensates which are optionally sulphonated. Other anionic polymers which may be employed include homo and copolymers of various carboxylic acids including acrylic acid, methacrylic acid and maleic acid and their derivatives. These include polymaleic acid and polyacrylates and polymethacrylates as well as copolymers of acrylamide and acrylic or methacrylic acid, including those which are obtained by the hydrolysis of polyacrylamide. Other polymers include copolymers acrylamide and AMPS (2-acylamido-2-methylpropane sulphonic acid) as well as copolymers of styrene or styrene sulphonic acid with maleic acid, acrylic acid or methacrylic acid.

It will, of course, be appreciated that the anionic polymers can be used either in the free acid form or in the form of water soluble salts thereof.

A considerable variety of different cationic polymers can be used. These include for instance, polyethyleneimines, especially low molecular weight polyethyleneimines, for example of molecular weight up to 5,000 and especially up to 2,000, including tetraethylene pentamine and triethylene tetramine, as well as various other polymeric materials containing amino groups such as those described in U.S. Pat. Nos. 3,250,664, 3,642,572, 3,893,885 and 4,250,299 but it is as generally preferred to use protonated or quaternary ammonium polymers. These quaternary ammonium polymers are preferably derived from ethylenically unsaturated monomers containing a quaternary ammonium group or are obtained by reaction between an epihalohydrin and one or more amines such as those obtained by reaction between a polyalkylene polyamine and ephichlorohydrin, or by reaction between epichlorohydrin dimethylamine and either ethylene diamine or polyalkylene polyamine. Other cationic polymers which can be used include dicyandiamide-formaldehyde condensates. Polymers of this type are disclosed in U.S. Pat. No. 3,582,461. Either formic acid or ammonium salts, and most preferably both formic acid and ammonium chloride, may also be included as polymerization reactants. One dicyandiamide-formaldehyde type polymer is commercially available as Tinofix QF from Ciba Geigy Chemical Ltd. of Ontario, Canada and contains as its active ingredient about 50 weight percent of polymer believed to have a molecular weight between about 20,000 and 50,000.

Typical cationic polymers which can be used in the present invention and which are derived from an ethylenically unsaturated monomer include homo- and copolymers of vinyl compounds such as vinyl pyridine and vinyl imidazole which may be quaternised with, say, a $C_1$ to $C_{18}$ alkyl halide, a benzyl halide, especially a chloride, or dimethyl or diethyl sulphate, or vinyl benzyl chloride which may be quaternised with, say, a tertiary amine of formula $NR_1R_2R_3$ in which $R_1$ $R_2$ and $R_3$ are independently lower alkyl, typically of 1 to 4 carbon atoms, such that one of $R_1$ $R_2$ and $R_3$ can be $C_1$ to $C_{18}$ alkyl; allyl compounds such as diallyldimethyl ammonium chloride; or acrylic derivatives such as a dialkyl aminomethyl(meth)acrylamide which may be quaternised with, say, a $C_1$ to $C_{18}$ alkyl halide, a benzyl halide or dimethyl or diethyl sulphate, a methacrylamido propyl tri($C_1$ to $C_4$ alkyl, especially methyl) ammonium salt, or a(meth)acryloyloxyethyl tri($C_1$ to $C_4$ alkyl, especially methyl) ammonium salt, said salt being a halide, especially a chloride, methosulphate, ethosulphate or $1/_n$ of an n-valent anion. These monomers may be copolymerised with a(meth)acrylic derivative such as acrylamide, an acrylate or methacrylate $C_1$–$C_{18}$ alkyl ester or acrylonitrile. Typical such polymers contain 10–100 mol % of recurring units of the formula:

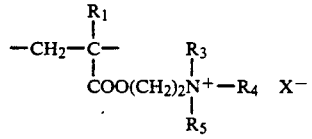

and 0–90 mol % of recurring units of the formula:

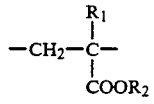

in which $R_1$ represents hydrogen or a lower alkyl radical, typically of 1–4 carbon atoms, $R_2$ represents a long chain alkyl group, typically of 8 to 18 carbon atoms, $R_3$, $R_4$ and $R_5$ independently represent hydrogen or a lower alkyl group while X represents an anion, typically a halide ion, a sulfate ion, an ethosulfate ion or $^1/n$ of a n valent anion.

Other quaternary ammonium polymers derived from an unsaturated monomer include the homo-polymer of diallyldimethylammonium chloride which possesses recurring units of the formula:

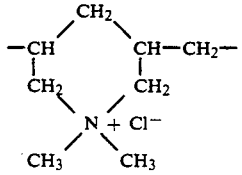

as well as copolymers thereof with an acrylic acid derivative such as acrylamide.

Other polymers which can be used and which are derived from unsaturated monomers include those having the formula:

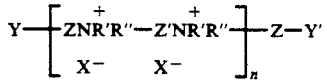

where Z and Z' which may be the same or different is $-CH_2CH{=}CHCH_2-$ or $-CH_2-CHOHCH_2-$, Y and Y', which may be the same or different, are either X or —NH'R'', X is a halogen of atomic weight greater than 30, n is an integer of from 2 to20, and R' and R'' (I) may be the same or different alkyl groups of from 1 to 18 carbon atoms optionally substituted by 1 to 2 hydroxyl groups; or (II) when taken together with N represent a saturated or unsaturated ring of from 5 to 7 atoms; or (III) when taken together with N and an oxygen atom represent the N-morpholino group, which are described in U.S. Pat. No. 4,397,743. A particularly preferred such polymer is poly(dimethylbutenyl) ammonium chloride bis-(triethanol ammonium chloride).

Another class of polymer which can be used and which is derived from ethylenically unsaturated monomers includes polybutadienes which have been reacted with a lower alkyl amine and some of the resulting dialkyl amino groups are quaternised. In general, therefore, the polymer will possess recurring units of the formula:

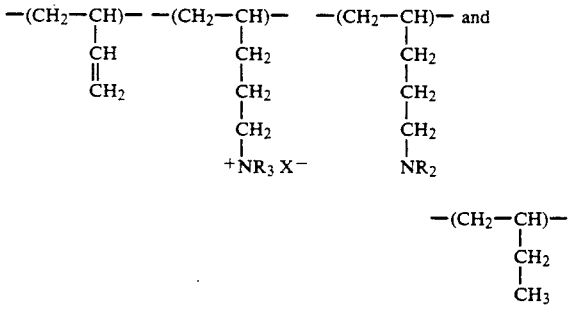

in the molar proportions $a:b_1:b_2:c$, respectively, where R represents a lower alkyl radical, typically a methyl or ethyl radical. It should be understood that the lower alkyl radicals need not all be the same. Typical quaternising agents include methyl chloride, dimethyl sulfate and diethyl sulfate. Varying ratios of $a:b_1:b_2:c$ may be used with the amine amounts $(b_1+b_2)$ being generally from 10–90% with $(a+c)$ being from 90%–10%. These polymers can be obtained by reacting polybutadiene with carbon monoxide and hydrogen in the presence of an appropriate lower alkyl amine.

Of the quaternary ammonium polymers which are derived from epichlorohydrin and various amines, particular reference should be made to the polymers described in British Specification Nos. 2085433 and 1486396. A typical amine which can be employed is N,N,N',N'-tetramethylethylenediamine as well as ethylenediamine used together with dimethylamine and triethanolamine. Particularly preferred polymers of this type for use in the present invention are those having the formula:

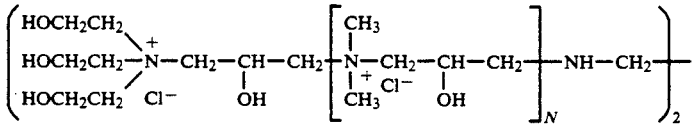

where N is from 0–500, although, of course, other amines can be employed.

Other polymers which can be used include cationic lignin, startch and tannin derivatives, such as those obtained by a Mannich type reaction of tannin (a condensed polyphenolic body) with formaldehyde and an amine, formed as a salt e.g. acetate, formate, hydrochloride or quaternised, as well as polyamine polymers which have been crosslinked such as polyamideamine/polyethylene polyamine copolymers crosslinked with, say, epichlorohydrin.

The preferred cationic polymers of this invention also include those made by reacting dimethylamine, diethylamine, or methylethylamine, preferably either dimethylamine or diethylamine with an epihalohydrin, preferably epichlorohydrin, such as those disclosed in U.S. Pat. No. 3,738,945 and CA-A-1,096,070. Such polymers are commercially available as Agefloc A-50, Agefloc A-50HV, and Agefloc B-50 from CPS Chemical Co., Inc. of New Jersey, U.S.A. These three products reportedly contain as their active ingredients about 50 weight percent of polymers having molecular weights of about 75,000 to 80,000 , about 200,000 to 250,000, and about 20,000 to 30,000, respectively. Another commercially available product of this type is Magnifloc 573C, which is marketed by American Cyanamide Company of New Jersey, U.S.A and is believed to contain as its active ingredient about 50 weight percent of a polymer having a molecular weight of about 20,000 to 30,000.

In addition polyquaternary polymers derived from (a) an epihalohydrin or a diepoxide or a precursor thereof especially epichloro- or epibromo-hydrin, (b) an alkylamine having an epihalohydrin functionality of 2, especially a dialkylamine having 1 to 3 carbon atoms such as dimethylamine and (c) ammonia or an amine which has an epihalohydrin functionality greater than 2 and which does not possess any carbonyl groups, especially a primary amine or a primary alkylene polyamine such as diethylaminobutylamine, dimethylamino propylamine and ethylene diamine. Such polymers can also be derived from a tertiary amine or a hydroxyalkylamine. Further details regarding such polymers are to be found in, for example, GB-A-2085433, U.S. Pat. No. 3,855,299 and U.S. Pat. No. Reissue No. 28,808.

The following Examples further illustrate the present invention. These were carried out on a test rig, which has the following features:

- flowbox to continuously deliver synthetic or actual backwater onto a wire or a felt;
- dewatering elements including hydrofoils, vacuum rolls and vacuum knives; and
- spray showers to continuously spray polymers onto wires or felts.

A paper machine forming wire or wet press felt is continuously rotated over three stainless steel rolls of which one is a vacuum roll (in the case of a wire the vacuum pump is switched off). Where the wire/felt is running horizontally, synthetic or actual back water is laid onto the wire/felt via a flow box. Before the flow box a double spray bar is fitted to spray the wire/felt while still moving in an upward direction. The two spray bars can be operated separately and are used to apply the anionic and cationic polymers.

The two pitch types used in the experiments had the following characteristics:

Pitch type I: mixture of tall oil fatty acids, having an anionic charge

Pitch type II: glycerol esters, virtually nonionic in nature

EXAMPLE 1

Rig runs were carried out using new wet press felts which were not pretreated by the manufacturer. All three felts were off-cuts of one standard paper machine felt and had therefore the same weave pattern. The manufacturer was Scapa-Porritt Ltd. of Cartmell Road, Blackburn, England, BB2 2SZ.

The synthetic back water used had the following composition:

| | |
|---|---|
| Widnes tap water | 99.800% |
| Pitch type I | 0.075% |
| Pitch type II | 0.025% |
| Calcium chloride dihydrate | 0.100% |

Each run was carried out at a back water temperature of 50° C. over a period of 6 hours. The felts were examined visually after the run and a qualitative assessment made.

Three separate rig runs were performed:

Blank run without any polymer (Run 1)

Run using one spray bar for the application of a blend of cationic polymer (Superfloc C573 from American Cyanamid, an ethylenediamine, dimethylamine, epichlorhydrin condensate; MW approximately 20,000–30,000) and cationic surfactant (a $C_{12,14,16}$ alkyldimethylbenzylammonium chloride blend) in a ratio of 1:1 (Run 2)

Run using two spray bars, one for the same cationic blend as above and the other for an anionic polymer (sodium lignosulphonate) (Run 3)

The results were as follows:

RUN 1

Heavy pitch deposits all over the felt. Large pitch agglomerates clogging the felt (microscopic evaluation). Pitch agglomerates unevenly distributed over and throughout the entire felt. First signs of pitch deposition already observed after 10 to 15 minutes running time of the felt. Pitch deposits were also noted in the flow box and on the stainless steel rolls.

RUN 2

Less pitch deposits. Pitch agglomerates were smaller and mainly on the surface of the felt, also unevenly distributed. First signs of pitch deposition were observed after approximately 2 hours running time of the felt. Still pitch deposits in the flow box but less deposits on the stainless steel rolls.

RUN 3

No pitch deposits on the felt at all. Even after 6 hours running time the felt was perfectly clean. There were still deposits in the flow box but hardly any pitch deposits on the stainless steel rolls.

N.B. The deposits in the flow box were not prevented because the pitch did not get in contact with the polymers prior to the felt since none of the synthetic back water which left the flow box was recirculated.

EXAMPLE 2

Rig runs were carried out on off-cuts of one standard forming wire manufactured by Unaform Ltd. of Stubbins Vale Mill, Ramsbottom, Bury, Lancashire, England, BLO ONT. They had therefore the same weave pattern.

The synthetic back water had the same composition as in Example 1.

The following rig runs were made:

Blank run not using any polymer (Run 1)

Run using one spray bar for the application of a cationic polymer (Darasperse 7951 from Grace Dearborn Ltd, a dicyandiamide/formaldehyde condensate; MW approximately 5,000) (Run 2)

Run using two spray bars, one for the application of the above cationic polymer and the other for an anionic polymer (sodium lignosulphonate), respectively (Run 3)

Each run was carried out at a back water temperature of 50° C. over a period of 6 hours. The wires were examined visually after the run and a qualitative assessment made.

The results were as follows:

RUN 1

Heavy pitch deposits all over the wire. Large pitch agglomerates clogging the wire. Pitch agglomerates unevenly distributed over the entire wire. First signs of pitch deposition already observed after 10 to 15 minutes running time of the wire. Pitch deposits were also noted in the flow box and on the stainless steel rolls.

RUN 2

Less pitch deposits. Pitch agglomerates were smaller and also unevenly distributed over the wire. First signs of pitch deposition were observed after approximately 3 hours running time of the wire. Still pitch deposits in the flow box but less deposits on the stainless steel rolls.

RUN 3

No pitch deposits on the wire at all. Even after 6 hours running time the wire was perfectly clean. There were still deposits in the flow box but hardly any pitch deposits on the stainless steel rolls.

N.B. The deposits in the flow box were not prevented because the pitch did not get in contact with the polymers prior to the wire since none of the synthetic back water which left the flow box was recirculated.

We claim:

1. A method for controlling pitch or stickies deposits on pulp or papermaking equipment surfaces which comprises applying to the equipment surfaces which are not in continuous contact with water a water soluble cationic polymer and a water soluble anionic polymer wherein the cationic polymer and the anionic polymer are applied separately.

2. A method according to claim 1 which comprises applying the water soluble cationic polymer and the water soluble anionic polymer to the pick-up felt, paper forming wire, press roll or dandy roll.

3. A method according to claim 1 in which the water soluble cationic polymer and the water soluble anionic polymer are sprayed onto the equipment.

4. A method according to claim 1 in which the cationic polymer has a molecular weight from 1,000 to 100,000.

5. A method according to claim 1 in which the cationic polymer is a polyethylene imine or a protonated or quaternary ammonium polymer.

6. A method according to claim 5 in which the cationic polymer is one derived from at least one amine and an epihalohydrin or a dicyandiamide formaldehyde condensate.

7. A method according to claim 1 in which the anionic polymer is a sulphonate or carboxylate.

8. A method according to claim 7 in which the anionic polymer is a lignin sulphonate or a polynaphthalene sulphonate.

9. A method according to claim 1 in which the water soluble cationic polymer and the water soluble anionic polymer are applied as separate aqueous solutions.

10. A method according to claim 9 in which the separate aqueous solutions also contain at least one surfactant.

* * * * *